United States Patent [19]

Martin

[11] Patent Number: 5,020,621

[45] Date of Patent: Jun. 4, 1991

[54] ELECTRIC MOTOR POWERED SKATEBOARD WITH INTEGRAL BRAKES

[76] Inventor: Christopher V. Martin, 8510 E. Jenan, Scottsdale, Ariz. 85260

[21] Appl. No.: 452,376

[22] Filed: Dec. 19, 1989

[51] Int. Cl.[5] ..... A63C 5/08

[52] U.S. Cl. ..... 180/181; 180/180; 180/342; 280/87.042; 301/5.3; 474/148

[58] Field of Search ..... 180/180, 181, 342, 10, 180/373, 9.34, 366, 357; 280/87.042; 474/148, 149, 150; 192/11; 301/5.3, 5.7

[56] References Cited

U.S. PATENT DOCUMENTS

| | | | |
|---|---|---|---|
| 1,672,700 | 6/1928 | Vass | 180/181 |
| 1,694,671 | 12/1928 | Rodelli | 180/181 |
| 2,798,565 | 7/1957 | Rosenthal et al. | 180/342 |
| 3,437,161 | 4/1969 | Ufford | 180/1 |
| 3,543,892 | 12/1970 | De Baillie | 192/11 |
| 3,876,032 | 4/1975 | Ferino | 180/9.2 |
| 4,069,881 | 1/1978 | Shiber | 180/1 |
| 4,073,356 | 2/1978 | Schlicht | 180/1 |
| 4,076,266 | 2/1978 | Krausz | 280/87.04 |
| 4,094,372 | 6/1978 | Notter | 180/1 |
| 4,143,728 | 3/1979 | Shiber | 180/1 |
| 4,183,546 | 1/1980 | Hellig | 280/87.04 |
| 4,317,872 | 3/1982 | Varma | 429/190 |

FOREIGN PATENT DOCUMENTS

| | | |
|---|---|---|
| 300837 | 1/1917 | Fed. Rep. of Germany . |
| 2723154-A1 | 12/1978 | Fed. Rep. of Germany . |
| 3205379-A1 | 8/1983 | Fed. Rep. of Germany . |
| 2604915 | 10/1986 | France . |
| 1026277 | 4/1964 | United Kingdom . |

*Primary Examiner*—Andres Kashnikow
*Assistant Examiner*—Eric Culbreth
*Attorney, Agent, or Firm*—Warren F. B. Lindsley

[57] ABSTRACT

An electrically driven brake controlled skateboard employing an electric motor and associated battery mounted on the bottom of its foot supporting board employs a pulley arrangement whereby the initial slipping of its belt acts as a clutch for transferring rotational power from the motor to a U-grooved drive wheel of the skateboard. The U-groove is low cut so that the drive belt is partially exposed to the road surface. A dual purpose tether mounted brake control and on/off switch is used to control the braking of the skateboard and the energization of the drive motor.

2 Claims, 2 Drawing Sheets

GO
STOP

ELECTRIC MOTOR POWERED SKATEBOARD WITH INTEGRAL BRAKES

BACKGROUND OF THE INVENTION

This invention relates to skateboards and more particularly to a clean, efficient, noiseless, electrically driven skateboard which may be controlled in a predictable manner.

A motorized skateboard basically comprises an elongated board, a pair of spaced truck (four wheels) one attached to the board under opposite ends thereof for supporting the board above the ground, a motor and a belt driven mechanism coupled to the motor for driving one or more of the four wheels of the board in response to the operation of the motor. The board is of sufficient dimension and strength to support a person riding thereon.

Typically, a gasoline motor has been attached to the truck at the rear end of the skateboard and is coupled to one of the rear skateboard wheels through a clutch mechanism so that power ca be disengaged when it is not desired to drive the board. In other models, a drive wheel is directly driven by the motor; but the motor is then restricted to high compression, small displacement engines which have to be push started, since there is no way of removing the driven wheel from the ground. Further, the gasoline engines are excessively noisy and hazardous to the environment and the storage of gasoline in such a small engine presents a heat and fire hazard to the operator and his or her surroundings. Due to the inherently small size and simple carburetion systems, these engines are difficult to start and dangerous to control without some dependable way to slow and stop the skateboard.

DESCRIPTION OF THE PRIOR ART

The following patents appear to be of novelty interest:

U.S. Pat. No. 3,876,032 discloses motorized skates which are driven by an electrical motor located on the skate frame. Power is supplied by a battery worn by the operator. A control panel located on the belt of the user has on/off switches for speed control.

Great Britain Patent No. 1,026,277 discloses motor driven footgear, the motor of which may be electric. A throttle and brake are connected by a flexible cable to a footboard.

U.S. Pat. No. 1,672, 700 shows another electrically driven roller skate. The motor is located on the skate, and a battery and rheostat to control the electric power are carried by the operator.

West German Patent No. DE 3205-379-A1 discloses a motorized skateboard employing a gasoline engine carried on the skateboard which is connected by a belt and pulley arrangement to the skateboard wheel or axle. Bowden cables provide acceleration and braking control.

U.S. Pat. No. 4,076,266 and West German Patent No. DE 2723-154-A1 show skateboard braking mechanisms in which the brake is actuated by a hand held cable.

Other patents of interest are listed below:

| | |
|---|---|
| 4,069,881 | 1,694,671 |
| 4,143,728 | 3,437,161 |
| 4,094,372 | France 2 604 915 |
| 4,073,356 | German 300837 |

-continued

| |
|---|
| 4,183,546 |

SUMMARY OF THE INVENTION

In accordance with the invention claimed a new and improved skateboard is provided employing a noiseless, clean and efficient means of propelling it and a safe, predictable means of stopping it. The disclosed electric motor overcomes most of the inherent drawbacks of the gasoline engine and is equipped with dynamic braking which predictably slow and stop the skateboard.

It is, therefore, one object of this invention to provide a new and improved motorized skateboard.

Another object of this invention is to provide a new and improved front or back wheel driven skateboard employing a brake and control mechanism which is particularly suitable for an electrical power driven means.

A further object of this invention is to provide a noiseless, clean, efficient, safe means of propelling a skateboard and a safe, predictable means of stopping it.

A still further object of this invention is to provide an improved motorized skateboard which is simple in construction and easy to operate from zero to normal and from normal to zero speeds.

A still further object of this invention is to provide a hand held motor control mechanism for a skateboard which permits the rider greater freedom of movement and control over the skateboard.

A still further object of this invention is to provide an improved skateboard powered by a replaceable battery pack.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWING

The present invention may be more readily described by reference to the accompanying drawings, in which.

DESCRIPTION OF THE PREFERRED EMBODIMENT

Figures 1, 2, 3A, 3B, 6:
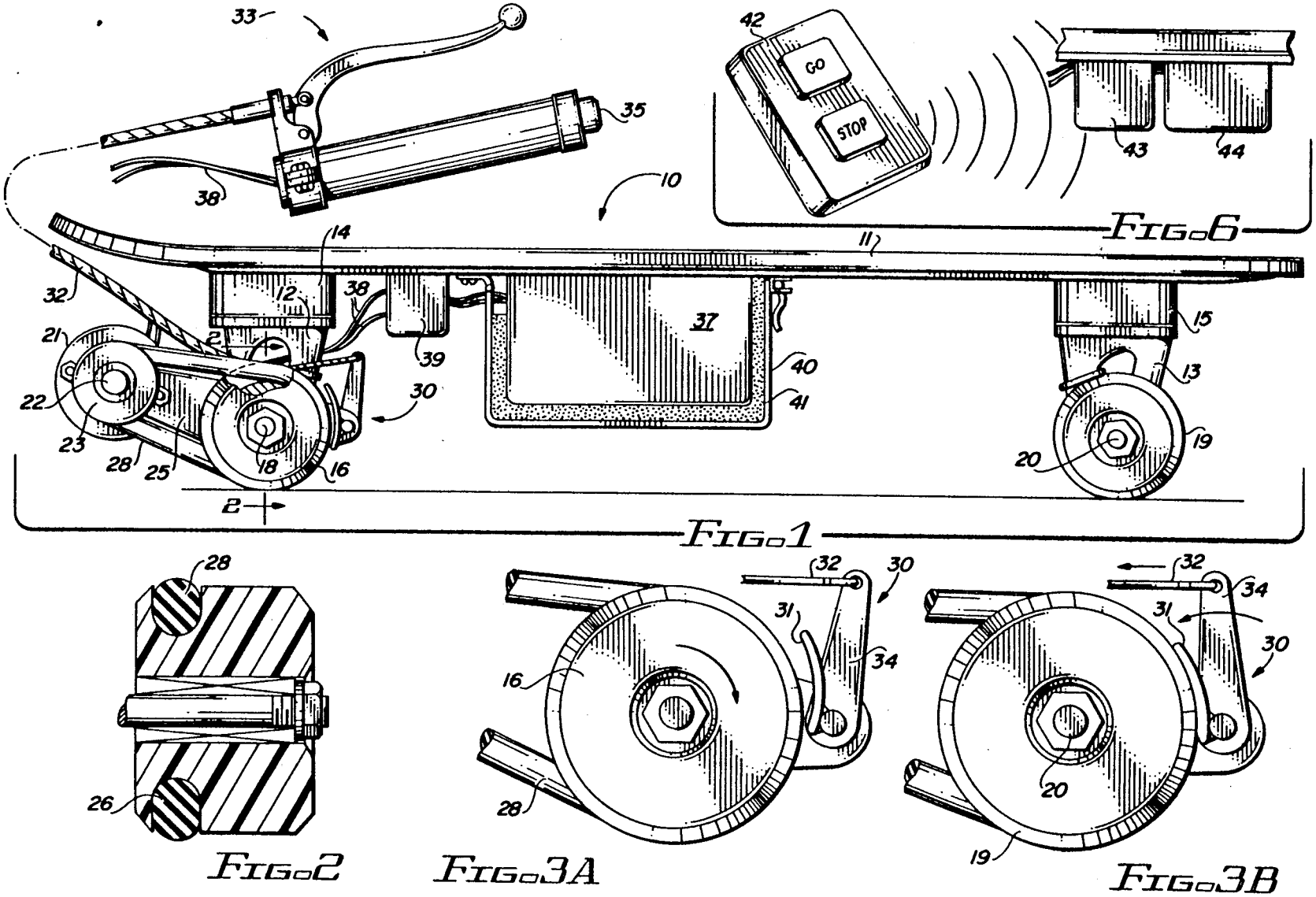
FIG. 1 is a perspective view partially in section of a skateboard and embodying the invention.
FIG. 2 is a cross sectional view of FIG. 1 taken along the line 2—2.
FIG. 3A is a view of the power driven wheel of FIG. 1 with the brake show disengaged from the wheel.
FIG. 3B is a view similar to FIG. 3A with the brake shoe in engagement with the driven wheel of FIG. 1.
FIG. 6 is a view of an alternate way of controlling the motor of the skateboard shown in FIG. 1.
Figure 4:
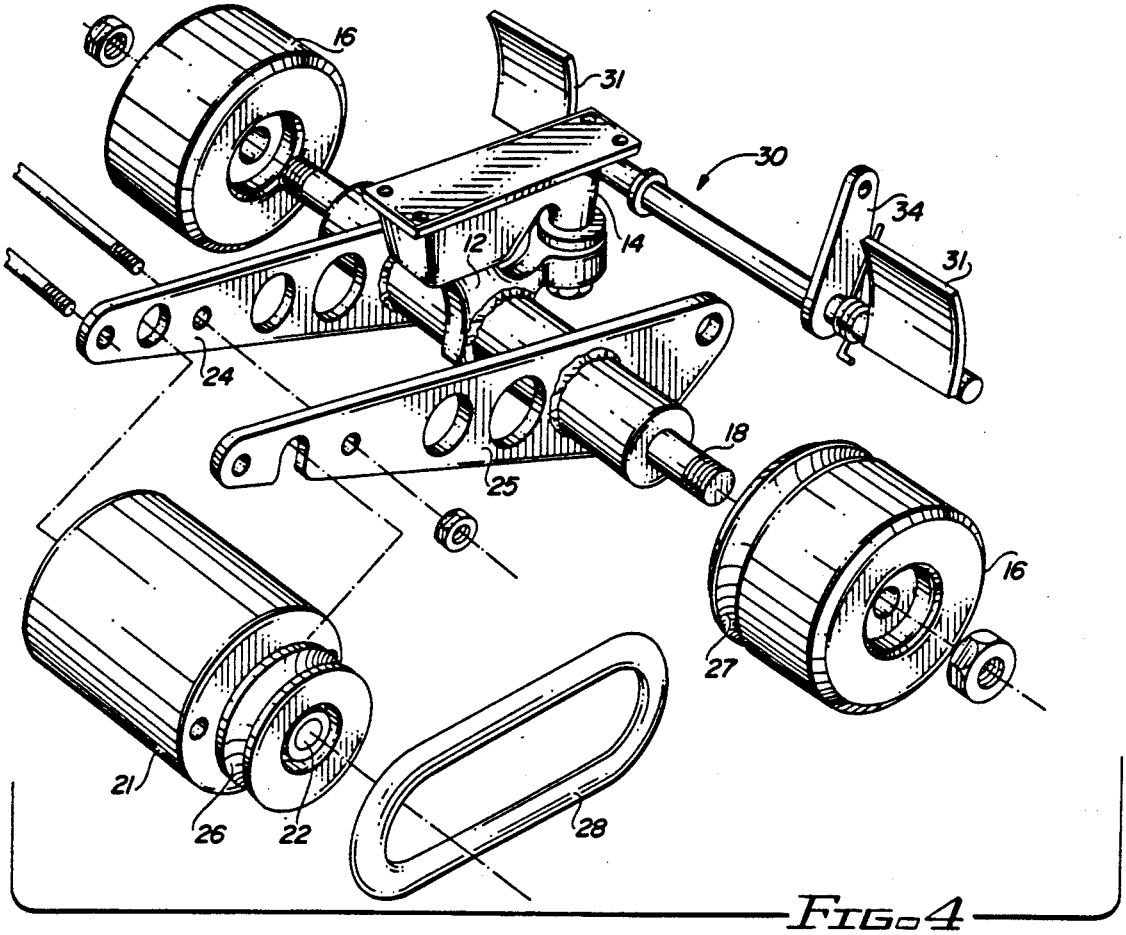
FIG. 4 is an exploded view of the drive mechanism and truck assembly shown in FIG. 1.
Figure 5:
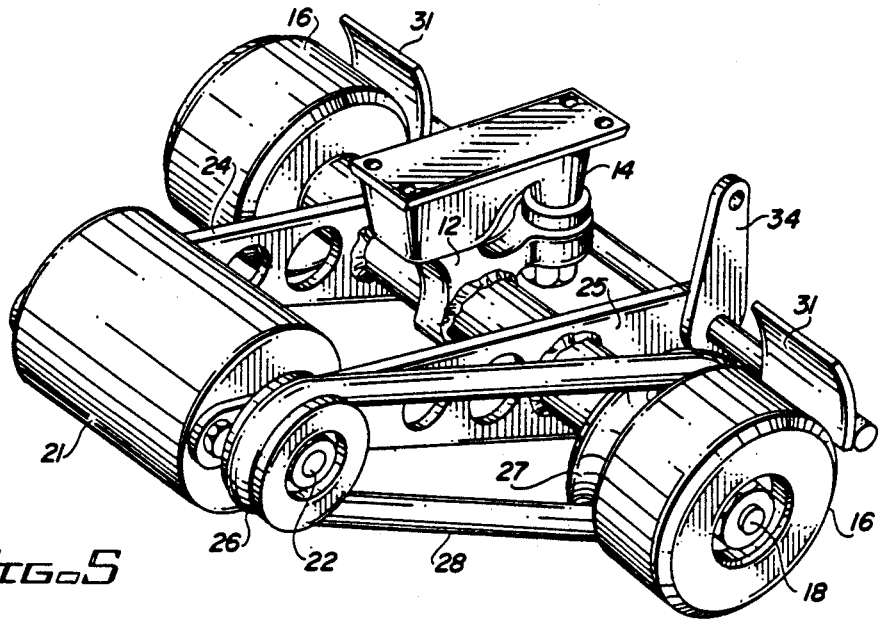
FIG. 5 is a perspective view of the assembly of the drive mechanism and truck assembly shown in FIGS. 1 and 4.

Referring more particularly to the drawings by characters of reference, FIG. 1 discloses a motorized skateboard 10 having a horizontal elongated board 11 the top surface of which provides a platform for the unfettered feet of a user which board is supported on trucks 12 and 13. These trucks are attached to board 11 under opposite end portions thereof by means of blocks 14 and 15, respectively. The trucks are designed to cause the respective pair of wheels to turn somewhat in response to angulation of the deck or board 11 such that the user may steer the skateboard by laterally shifting his or her weight. The board is essentially rigid and may be formed of various materials such as resinous plastic materials, metal, wood, fiberglass or the like.

The back truck 12 is provided with a pair of spaced wheels 16 which are founded on fixed axle 18 and attached to the underside of the forward portion of board 11. The front wheels 19 are rotatively mounted to axle 20 and are attached to the underside of the front portion of board 11. It should be noted that either end of the board may be designated the front or rear of the skateboard.

An electric motor 21 such as commonly employed to provide motive power such as, for example, a ¼ horse power unit comprising a rotor 22 and stator 23 is mounted on truck 12 by means of a pair of spacedly mounted brackets 24 and 25. A V or U-shaped pulley 26 is attached to rotor 22 of motor 21. One of the wheels 16 of truck 12 may be the drive wheel of the skateboard and it is either grooved or provided with a pulley arrangement 27 for receiving therein a belt 28 which interconnects pulley 26 with pulley arrangement 27 for driving axle 18 and power wheels 16 of the skateboard. The drive mechanism can be belt, tooth belt, chain, direct engine drive, geared drive, friction drive and angle gear drive and still fall within the scope of this invention.

Wheels 16 are controlled by a control mechanism 30 which comprises a pair of axle mounted interconnected movably supported brake blocks or shoes 31 which shoes are positionable against the rear wheels 16 by brackets 24 and 25 and are operated by the known Bowden cable 32 connected at one end to a grip handle 33 and at the other end to bracket 34. The Bowden cable when actuated causes the brake shoe (friction material coated) to be moved against spring tension one against each of the rear wheels 16. The brake blocks 31 are moved radially to and from the axis of the drive wheels 16 to engage and disengage the drive wheels for braking purposes.

It should be noted that the flexible Bowden wire cable means doubles as a brake line and tether with one end of the cable being mounted to the skateboard such that its sheath is substantially immobile relative thereto and said core is connected to brake shoes 31 through bracket 34 such that the axial motion of the core of the cable mean moves the brake blocks 31 between a first position clear of wheels 16 and to a second position frictionally engaging wheels 16.

As noted from FIGS. 3A and 3B of the drawings, the leading edge of brake shoe or block 31 engages the associated wheel first with continued brake pressure causes this edge of the shoe or block to more firmly engage the wheel.

As noted from the drawings, control mechanism 30 employs the brake type squeeze grip 33 that is connected to the Bowden cable mechanism 32. Part of the squeeze grip 33 comprises an on/off switch 35 that is electrically connected in sequence with motor 21 and its energizing battery 37 through conductor 38 so that the operator can control the speed of the skateboard by merely energizing and de-energizing the motor as he or she sees fit. Not only is this a safety feature because the drive power can be cut off instantly, but it also saves the battery charge by merely energizing the motor when needed.

It should be noted that the on/off switch 35 may be normally in the off position and require finger pressure on the switch to switch it to the on position for energizing the motor for safety purposes.

Battery 37 may be of the gel/cell or maintenance free lead acid type the current of which is transmitted to motor 21 through a relay 39, which relay is controlled by the operator using the momentary on/off switch 35. The battery is secured to the bottom of board 11 of skateboard 10 by one or more quick release straps 40 and is insulated from vibration by at least a partially encasing foam pad 41.

It should be noted that a rheostat (not shown) may be used in place of the on/off switch for controlling the motor in a known manner. Further, as shown in FIG. 6, the motor may be controlled by a hand held transmitter 42 that transmits "go" and "stop" signals to a relay 43 through a receiver 44 for dynamic engine or motor braking.

OPERATION OF THE SKATEBOARD

When the skateboard is intended to be rendered mobile, the momentary switch 35 is turned on by the hand of the user sending current to relays 39 or 43 which energizes motor 21. The motor rotates turning associated U-shaped grooved pulley 26 by slipping belt 28 until operational speed of the skateboard is obtained.

The belt transfers rotation power to front or back wheels 16 via the groove in the pulley arrangement 27 formed in or associated with the power wheel 16 at the front or the back of the skateboard. The groove in pulley arrangement 27 is low cut in that the belt is partially exposed to the road surface and compressed into the groove during use so that slippage does not occur at this point.

Current is furnished motor 21 by the operator through his or her on/off operation of switch 35. The brakes are of the friction type which incorporates two brake shoes, one for each of power wheels 16 which are controlled by the operator through a tether comprising the Bowden cable 33 and conductor 38.

Although but two embodiments of the invention have been illustrated and described, it will be apparent to those skilled in the art that various changes and modifications may be made therein without departing from the spirit of the invention or from the scope of the appended claims.

What is claimed is:

1. A motorized skateboard for the unfettered feet of a user comprising:

an elongated board having top and bottom surfaces with its top surface forming a platform for the unfettered feet of a user;

truck means comprising a pair of spaced wheel supporting axles journaled on the bottom surface of said board and laterally thereacross;

frictional means mounted on the bottom of said board and being movable from a first position clear of the wheels of one of said truck means to a second position frictionally engaging at least one of the associated wheels to brake same;

an electric motor mounted on the bottom of said board and connected to one of said pair of axles for rotation thereof;

a battery detachably mounted on the bottom of said board and connected to said motor through an on/off switch;

an on/off switch means interconnecting said motor and said battery for controlling the energization of said motor and the rotation of said one of said axles;

motor control means carried by the user of the skateboard for controlling said motor; and pulley means interconnecting said motor with said one of the axle supported wheels for rotation thereof, said pulley means comprises a pulley connected to said motor and having a shallow U-shape groove formed therein for cooperation with a drive belt, said shallow U-shape groove being provided in one of the wheels of one of said pair of axles for receiving said drive belt which exposes said belt to a ground surface during operation of said skateboard.

2. A motorized skateboard for the unfettered feet of a user comprising:

an elongated board having top and bottom surfaces with its top surface forming a platform for the unfettered feet of a user, truck means comprising a pair of spaced axle mounted support wheels journaled on the bottom surface of said board and laterally thereacross, frictional means mounted on the bottom of said board and being movable from a first position clear of the wheels of one of said truck means to a second position frictionally engaging at least one of the associated wheels to brake same, a flexible Bowden wire cable means doubling as a brake line and a tether with one end of said cable being mounted to said skateboard such that its sheath is substantially immobile relative thereto and said core is connected to said frictional means such that the axial motor of said core moves said frictional member between said first and second positions, hand grip means mounted on the other end of said cable, said hand grip means being operable to displace said core axially relative to said sheath when said hand grip means is squeezed to brake said skateboard, an electric motor mounted on the bottom of said board and connected to one of said pair of axles for rotation thereof, a battery detachably mounted on the bottom of said board and connected to said motor through an on/off switch, an on/off switch means forming a part of said hand grip means and said cable means interconnecting said motor and said battery for controlling the energization of said motor and the rotation of said one of said axles, and pulley means interconnecting said motor with said one of the axle supported wheels for rotation thereof, said pulley means comprising a pulley connected to said motor and having a U-shape groove formed therein for cooperation with a drive belt, said pulley means comprising a shallow groove in one of the wheels of one of said pair of axles for receiving said drive belt which exposes said belt to ground surface during operation of said skateboard to facilitate belt grip.

* * * * *